United States Patent [19]

Preist et al.

[11] Patent Number: 4,480,210

[45] Date of Patent: Oct. 30, 1984

[54] GRIDDED ELECTRON POWER TUBE

[75] Inventors: Donald H. Preist, San Mateo; Merrald B. Shrader, Los Altos, both of Calif.

[73] Assignee: Varian Associates, Inc., Palo Alto, Calif.

[21] Appl. No.: 377,498

[22] Filed: May 12, 1982

[51] Int. Cl.[3] ..... H01J 25/00

[52] U.S. Cl. ..... 315/4; 313/293; 332/7; 315/5; 315/5.29; 315/5.37; 315/5.32

[58] Field of Search ..... 315/4.5, 5.29, 5.37, 315/5.31, 5.32, 5.33; 332/7, 13, 58; 313/293, 295, 348

[56] References Cited

U.S. PATENT DOCUMENTS

| | | | |
|---|---|---|---|
| 2,439,387 | 4/1948 | Hansen et al. | 332/58 X |
| 2,795,761 | 6/1957 | Bradley | 332/7 |
| 2,850,664 | 9/1958 | Naill | 313/293 X |
| 2,886,733 | 5/1959 | Naill | 313/293 X |
| 3,051,865 | 8/1962 | Marchese | 332/13 X |
| 3,116,435 | 12/1963 | Heil | 315/5.51 |
| 3,453,482 | 7/1969 | Preist | 315/5.29 |
| 3,801,854 | 4/1974 | Giebeler | 315/5.29 |

*Primary Examiner*—Saxfield Chatmon
*Attorney, Agent, or Firm*—Stanley Z. Cole; Peter J. Sgarbossa

[57] ABSTRACT

An efficient relatively high-power inductive output linear electron beam tube with broad-band capabilities is disclosed which is density modulated with a grid applying to the beam an RF modulating signal. The grid has a large active area which may be of the order of ten square inches, is closely spaced one-twentieth the grid diameter or less to a thermionic cathode, and is comprised of a plurality of curved thin narrow elongated members. With the aid of an annular anode downstream of the grid, the beam is accelerated by DC potential of at least several kilovolts. A high-isolation input signal means includes adjacent but physically and electrically isolated wide-diameter, axially reduced annular cathode and grid lead means for leading both the DC beam-accelerating potential into the cathode, and the modulating RF signal into the grid with minimal impedance. A grid support means at one end of the grid peripherally engages the grid with a resilient deformable contact member to facilitate differential expansion without grid distortion while accurately maintaining the close grid to cathode spacing. The resulting density modulation forms the beam into correspondingly high-density moving bunches of electrons. An axial drift tube means encloses the beam, extends to a collector, and is interrupted by a gap. A coaxial resonant cavity about the drift tube, and into which the gap opens allows the bunches passing closely past the gap to induce efficiently in the cavity a VHF, UHF or microwave output signal corresponding to the modulating signal, but with an output power of at least a kilowatt.

75 Claims, 4 Drawing Figures

GRIDDED ELECTRON POWER TUBE

FIELD OF INVENTION

This invention relates to a radio-frequency tube whose electron beam is density-modulated by a grid carrying an RF signal, and whose RF output is extracted via induction by a resonant cavity. More particularly, the invention relates to an improved design for such inductive output tube, whereby continuous high power outputs are provided in excess of kilowatt levels at radio frequencies ranging upwardly into the microwave region.

BACKGROUND OF INVENTION

For many years the inductive-output linear-beam density-modulated electron tube has been a basic but neglected design since its development by A. V. Haeff in 1939. See "An Ultra High Frequency Power Amplifier of Novel Design" by A. V. Haeff, Electronics, February 1939; and "A Wideband Inductive Output Amplifier" by A. V. Haeff and L. S. Nergaard, Proceedings of the IRE, March, 1940. Haeff himself noted in his second paper the high interest then being generated by the contemporaneous work of the Varian brothers on velocity-modulated linear-beam microwave tubes. Such tubes, exemplified originally by the klystron, soon overwhelmed the field, since unlike the Haeff tube, they were not limited in frequency by electron transit time problems, nor was power limited by a grid. Consequently, no commercial applications of the Haeff tube have occurred during the past thirty or more years.

Nevertheless, the Haeff-type tube does have some advantages. In certain useful frequencies, especially the 100–300 megahertz band, it can be of much smaller length than a comparable klystron. In certain applications, especially as a linear amplifier in AM service, it can have a higher average efficiency. As in classical triodes, the electron beam current varies with the drive level. By contrast, in a conventional klystron the beam is invariant with drive level, so that it is comparatively less efficient at low signal levels.

Compared to a classical triode, the Haeff-type tube shares many of the advantages of klystrons, i.e., more power gain, simpler construction, output cavity at ground potential, and a collector which is separate from the output cavity and which can be made quite large for handling high waste beam power.

Such advantages, however, have been essentially unavailable due to the shortcomings of the Haeff-type tube, especially the comparative low output power heretofore possible. The earliest designs of Haeff produced about 10 watts CW output at 450 Mhz; later this was increased to 100 watts; beam voltages were at the 2 kilovolt level. However, these power levels are far short of practical requirements for modern communications and other applications. The Haeff-type tube has heretofore not been adaptable to higher power applications, and thus its advantages have continued to remain unavailable, particularly in applications, for example, television broadcasting, requiring kilowatt-level CW RF power and beyond. Generally the need has continued unfulfilled for a vacuum tube of compact design having the high efficiency and broadband characteristics for operations, especially in the 100–1000 MHz range and above, and especially at power levels in the kilowatt to megawatt CW range.

SUMMARY OF INVENTION

Accordingly, an object of the invention is to provide an RF electron tube of compact design, with high efficiency, adaptable for use over a broad range of frequencies, while capable of providing at least one kilowatt level CW RF power output.

A related object of the invention is to provide an electron tube with many of the advantages of a klystron, but with greater compactness and efficiency, while delivering adequate output power.

Another object of the invention is to provide an inductive-output linear-beam density-modulated tube having greatly improved power output, efficiency, and usable over VHF, UHF, and microwave frequencies.

A further related object is to provide an improved inductive output linear beam density modulated tube capable of operating in the 100 MHz frequency range and above, and capable of providing a power output of at least kilowatt continuous RF power.

Yet another related object is to provide a broad-bandwidth low impedance, high-isolation signal input means simultaneously handling a high frequency, VHF, UHF or microwave control grid-modulating signal, and a kilovolt-level DC beam accelerating potential.

A more specific related object is to provide a control grid assembly as part of the signal input means capable of handling high thermal and electrical stresses while efficiently modulating an electron beam at kilovolt DC potential with a multiwatt RF modulating signal.

These objects are achieved by the provision of an inductive-output-linear-beam density-modulated electron tube for use with means providing an electron-beam focusing field, and an inductive RF output means. The tube includes an axially-centered electron gun assembly at one end of the tube, and an anode spaced therefrom. The cathode and anode are operable at a minimum several kilovolts DC electrical potential therebetween, to form and accelerate an electron beam along the axis. The tube includes axial collector means at the other end of the tube for accepting and dissipating the electrons of the beam which remain after transit across the tube; and axial drift tube means enclosing the beam, which extends between the anode and collector, with the drift tube being interrupted by a gap generally intermediate the gun and collector. The gap opens into the inductive means, and axially extends at least twice the radius of the drift tube at the gap. An axially centered grid between anode and cathode is closely spaced a predetermined distance from the cathode and accepts a high frequency control signal to density-modulate the beam, said distance being one-twentieth the diameter of the grid or less. Low impedance input signal means having adjacent but electrically isolated grid lead means and cathode lead means supplies both the cathode with the several kilovolts potential, and the grid with the RF modulating signal. Means associated with this signal input means supports the grid and accommodates differential expansion while accurately maintaining the predetermined grid-cathode distance. In this manner the electron beam is density-modulated by the high-frequency control signal, and an RF output of the order of kilowatt or greater CW power level, varying in accordance with the control signal, is provided.

In a preferred embodiment, the high isolation input signal means includes an annular insulator means with one end hermetically sealed to the anode radially outward of the axial anode aperture, an annular electrically conductive grid lead means hermetically sealed to the other end of the annular insulator means, and extending toward the anode radially within the insulator means, with the grid lead means mounting the grid support means, and being capable of accepting the RF modulating signal. The input signal means further includes electrically conductive cathode lead means positioned radially within the grid lead means and connected thereto via electrically insulating means, the cathode lead means mounting the cathode closely adjacent the grid, and capable of accepting a high voltage DC electrical potential with respect to the anode. The outer end of the cathode lead means is recessed substantially closer to the anode than is the outer end of the grid lead means, for enhanced DC-RF isolation. In this manner, an input signal structure is provided which accepts both a high voltage DC potential to accelerate the beam, and a grid-modulating RF signal by means of closely adjacent lead means which nevertheless afford high electrical isolation. Also, this relative disposition of the conductive and insulative component parts of the input structure minimizes input inductance and capacitance, thereby providing a bandwidth capability considerably greater than in the earlier Haeff tube.

The preferred embodiment further desirably includes a grid generally between 0.6 and 16.0 square inches active area, of thickness of the order of 20 mils or less, and spaced from the cathode a distance of between 5 to 50 mils, while being comprised of a plurality of thin elongated spaced-apart narrow members which may be fabricated of a form of highly stable heat-resistant carbon. Also desirably included is a means for resiliently maintaining such close spacing under conditions of high temperature operations and considerable differential expansion. In this manner a high current kilovolt level electron beam may be effectively closely density modulated with a VHF-UHF-microwave modulating RF signal to reliably achieve considerably greater efficiency, frequency range and power output than even before possible.

Other features and advantages will be apparent upon consideration of the following description in connection with the drawings, wherein.

DETAILED DESCRIPTION

Figure 1:
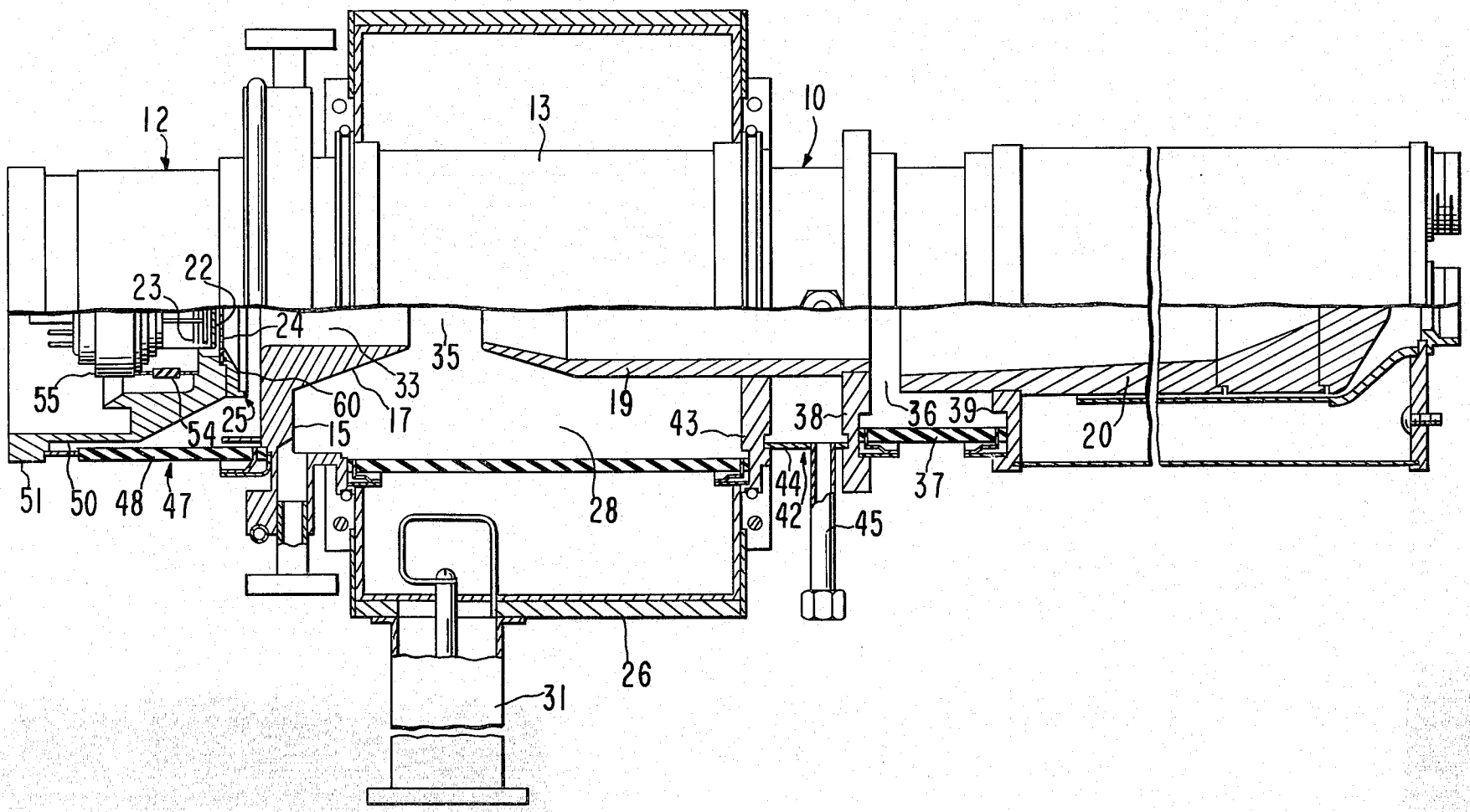
FIG. 1 is a longitudinal view, partially in cross-section, of an inductive-output, linear-beam density-modulated tube employing the improvements of the present invention.

Referring now to the drawings, FIG. 1 shows an elongated electron tube 10 defining a longitudinal axis which structurally is fairly analgous to that of a typical klystron, but which functions quite differently. Its main assemblies include a generally cylindrical electron gun and signal input assembly 12 at one end, a segmented tubular wall 13 including ceramic and copper portions defining a vacuum envelope, an axially apertured anode 15, which is extended axially to become the anode drift tube 17; a downstream "tail pipe" drift tube 19; and a collector 20 at the other end of tube 10, all axially centered and preferably of copper.

The gun assembly 12 includes a flat disc-shaped thermionic cathode 22 of the tungsten-matrix Philips type, back of which a heating coil 23 is positioned; a flat electron-beam modulating grid 24 of a form of temperature-resistant carbon, preferably pyrolytic graphite; and a grid support and retainer subassembly 25 for holding the grid very accurately but resiliently in a precisely predetermined position closely adjacent the cathode. The cathode and grid are of relatively large diameter, to produce a correspondingly-sized cylindrical electron beam and high beam current. A still larger cathode could be utilized with a convergent beam, as well-known in other tubes. Either higher power could be obtained, or reduced cathode current density, along with a resulting longer lifetime and improved bandwidth.

A reentrant coaxial resonant RF output cavity is defined generally coaxially of both drift tube portions intermediate gun 12 and collector 20 by both a tuning box 26 outside the vacuum envelope, and the interior annular space 28 defined between the drift tubes and the ceramic 13 of the tubular envelope extending over most of the axial extent of the tail pipe 19 and anode drift tube 17. Tuning box 26 is equipped with an output means including a coaxial line 31, coupled to the cavity by a simple rotatable loop. This arrangement handles output powers on the orders of tens of kilowatts at UHF frequencies. Higher powers may require integral output cavities, in which the entire resonant cavity is within the tube's vacuum envelope; a waveguide output could also be substituted. Also, additional coupled cavities may be employed for further bandwidth improvement. Although the preferred embodiment utilizes reentrant coaxial cavity 26, other inductive-circuit RF output means could be employed as well which also would function to convert electron beam density-modulation into RF energy.

An input modulating signal at frequencies of at least the order of 100 MHz and several watts in power is applied between cathode 22 and grid 24, while a steady DC potential typically of the order of between 10 up to at least 30 kilovolts is maintained between cathode 22 and anode 15, the latter preferably at ground potential. The modulating signal frequency can be lower as well as higher, even into the gigahertz range. In this manner, an electron beam of high DC energy is formed and accelerated toward the aperture 33 of anode 15 at high potential, and passes therethrough with minimal interception. Electromagnetic coils or permanent magnets positioned about the gun area outside the vacuum envelope, and about the downstream end of tail pipe 19 and the initial portion of collector 20, provide a magnetic field for the beam to aid in confining or focusing it to a constant diameter as it travels from the gun to the collector, and in assuring minimal interception through the anode. However, the magnetic field, although desireable, is not absolutely necessary, and the tube could be electrostatically focused, as with certain klystrons.

The modulating RF signal imposes on the electron beam a density modulation, or "bunching", of electrons in correspondence with the signal frequency. This density-modulated beam, after it passes through anode 15, then continues through a field-free region defined by the anode drift tube interior at constant velocity, to emerge and pass across an output gap 35 defined between anode drift tube 17 and tail pipe 19. Anode drift tube 17 and tail pipe 19 are isolated from each other by gap 35, as well as by tubular ceramic 13 which defines the vacuum envelope of the tube in this region. Gap 35 is also electrically within resonant output cavity 26. Passage across gap 35 of the bunched electron beam induces a corresponding electromagnetic-wave RF signal in the output cavity which is highly amplified compared to the input signal, since much of the energy of the energy of the electron beam is converted into microwave form. This wave energy is then extracted and directed to a load via output coaxial line 31.

After passage past gap 35, the electron beam enters tail pipe drift tube 19, which is electrically isolated not only from anode 15, but also from collector 20 by means of second gap 36 and tubular ceramic 37 and which defines a second field-free region. The ceramic 37 bridges the axial distance between copper flange 38 supporting the end of tail pipe 19, and copper flange 39 centrally axially supporting the upstream portion of collector. Thus, the beam passes through the tail pipe region with minimal interception, to finally traverse second gap 36 into the collector, where its remaining energy is dissipated. Collector 20 is cooled by a conventional fluid cooling means, including water jacket 40 enveloping the collector and through which fluid, such as water, is circulated. Similarly, anode 15 and tail pipe 19 are each provided with respective similar cooling means, best shown in FIG. 1 for the tail pipe. Means 42 includes axially-spaced parallel copper flanges 38 and 43 perpendicular to the tube axis. These, together with cylindrical envelope jacket 44 therebetween, define an annular space about the downstream end of tail pipe 19 within which liquid coolant such as water is introduced by means of inlet conduit 45, circulated, and returned through a similar outlet conduit. Although described as a unitary element in the preferred embodiment, it should be understood that collector 20 could also be provided as a plurality of separate stages.

Figure 2:
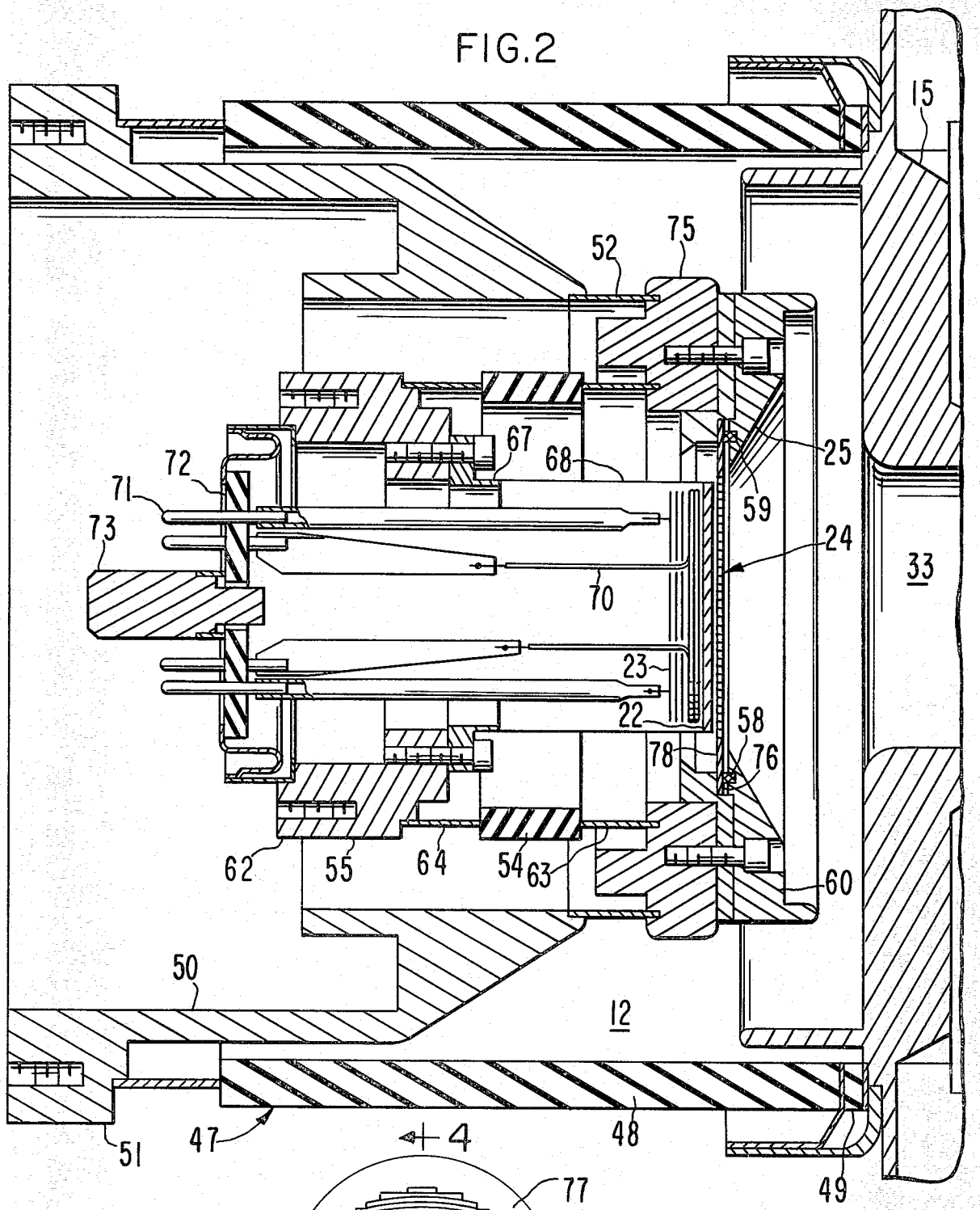
FIG. 2 is an enlarged detail longitudinal cross-section view of the electron gun and signal input assembly of the tube of FIG. 1.

The construction of electron gun assembly 12 at one end of the tube is especially adapted for effecting broadband efficient RF density modulation of the electron beam, and is shown in more detail in FIG. 2. It includes both the control grid 24 and grid support means 25, as well as a high-isolation low-impedance signal input means 47, by which not only the RF modulating signal of at least several watts power and at least megahertz frequency is led into the control grid, but also by which the kilovolt level DC beam accelerating potential is applied to the cathode.

The outermost element of signal input means 47 is a tubular or annular ceramic insulator 48, axially comparatively shallow compared to its diameter, and which is at one end 49 thereof hermetically sealed to anode 15, and which is axially centered radially outwardly of anode aperture 33. An annular conductive sleeve 50 has a trailing end 51 at which the RF control signal is accepted, is roughly of diameter comparable to ceramic 48, and extends axially rearwardly of insulator 48. Sleeve 50 is supported on ceramic 48 by being mounted coaxially thereto at its trailing end 51. From end 51, sleeve 50 extends axially and generally radially inwardly toward anode 15, to terminate in a leading end 52. Leading end 52 also includes an integral rear rim portion, which provides a flange 63 projecting axially rearwardly toward end 51, and which is suitable for aiding connection with a modulating signal input line. Leading end 52 of sleeve 50 is reduced radially inwardly to a relatively small diameter less than that of insulator 48 or anode 15. By means of an inner axially relatively shallow annular insulator 54, there is mounted to, and concentrically within, leading end 52 the annular metallic cathode lead-in 55, recessed toward leading end 52 well inwardly of outer conductive sleeve 50.

All joints are vacuum-tight since the volume within outer insulator 48, sleeve 50, and cathode lead-in 55 is within the evacuated portion of the tube. Metallic sleeve 50, preferably of relatively thick copper, serves both as the RF signal lead-in path to grid 24, and also as the ultimate grid support member along with insulator 48. Outer insulator 48 serves not only to mount outer conductive sleeve 50, and as a part of the outer vacuum envelope, but also to help isolate the incoming RF modulating signal from the anode and cathode space. The axial length of any coaxial current paths compared to their diameter is small, while their radial and axial spacing, both due to geometry and the interposition of insulators, is comparatively large, thus minimizing series inductance and shunt capacitance effects. A very low reactance to the modulating RF signal results, contributing to high overall bandwidth.

In order to handle the relatively large beam currents required to yield relatively high power output, the grid, cathode and beam cross-sections are relatively large in area, thus keeping current density over the grid and cathode to reasonable levels. As mentioned above, this increased area may be provided by means of a convergent electron gun having a spherical or concave cathode surface and a correspondingly-shaped grid, as seen in other RF tubes. At the same time, the need to minimize electron transit time loading in order to obtain high efficiency and bandwidth, with high upper frequency limits, requires the grid to be one which is as thin as possible compared to its diameter, and to be as closely spaced as possible to the cathode. The grid-to-cathode spacing achievable by the present invention is on the order of one-twentieth the diameter of the grid or less, while the thickness of the grid is on the order of half this distance or less. Such a relatively thin, closely spaced grid would heretofore have been considered impracticable as subject to failure due to shorts, or to changes in operating characteristics, or to mechanical breaks under the heat and differential expansion stresses imposed by the operating environment. But in the latest embodiments of the present tube, such grid-to-cathode spacing has been reduced far beyond even the foregoing values, having been brought down to about one-hundredth of the grid diameter. Such desireably close configurations, and the attendant improvements in performance characteristics, have been totally unexpected.

To further help in obviating the above-mentioned causes of failure and at the same time to preserve the low impedance signal path to the grid for the RF modulating signal, the control grid support and retaining subassembly 25 in association with leading end 52 of grid lead-in sleeve 50 is provided. This subassembly accommodates relative expansion between grid 24 and its environment while accurately maintaining the close predetermined grid-to-cathode spacing, a low impedance RF signal path, as well as a superior thermal pathway from the grid, for enhanced heat dissipation. Basically, a deformable resilient annular conductor 58 protruding from an annular groove 59 in leading end 52 peripherally contacts grid 24 on one face thereof, the other face being peripherally contacted by an annular outer member 60 fastened to leading end 52, as will be described in more detail below. In this manner, grid retaining subassembly 25 is supported upon the grid RF lead-in 50, and is electrically and physically continuous therewith to maintain the low impedance lead-in path for the RF modulating signal to the grid.

In the associated signal input means 47, the cathode lead-in member 55 is of a diameter smaller than reduced end 52, and on the order of half the diameter of outer insulator 48, or less. The trailing end 62 of cathode lead-in 55 is recessed axially inwardly of outside or trailing end 51 of grid lead-in 50, substantially closer to anode 15 then to expanded diameter trailing end 57. The extra degree of physical separation enhances the isolation between the RF signal and the DC beam accelerating potential for the cathode. Cathode lead-in 55 is mounted within leading end 52 of grid lead-in 50 by means of two axially centered thin metallic annuli 63 and 64, each hermetically sealed respectively to cathode lead-in member 55 and leading end 52, and separated by the inner ceramic annular insulator 54 therebetween. The diameter of insulator 54 is comparable to cathode lead-in 55, and insulator 54 is very shallow axially in comparison to its diameter, as are metallic annuli 63 and 64. Cathode lead-in 55 and inner insulator 54 are generally axially coextensive with leading end 52. The insulator 54 not only isolates the cathode lead-in 55 from the RF present at grid 24 and grid support 25, but also forms part of the vacuum envelope of the gun assembly, as mentioned above.

Cathode lead-in member 55 includes both enlarged diameter trailing or base end 62, and a reduced diameter leading end 67 axially extending toward the anode, comprising an elongated reduced diameter hollow metallic cylinder 68. Cathode base end 62 and inner insulator 54 are positioned axially in line, with cylinder 68 extending through insulator 54. Cylinder 68 terminates in disc-shaped cathode 22 retained therewithin and closing off the cylinder, cathode 22 being thereby supported in close proximity to control grid 24 at the predetermined cathode-grid spacing. Just inside cathode 22 within hollow cylinder 68 are heater elements 23. These may, for example, be spiral or in any other conventional form; their support and electrical lead-in wires 70 extend parallel to the tube central axis, to terminate in pins 71. The latter are retained in a disc-shaped ceramic termination plate 72, which is hermetically sealed to cathode lead-in member 55, and which mounts an axial rearwardly-extending guide stem 73. Insulating the trailing end portion 67 of the cathode lead-in in this manner seals off the gun assembly and completes the vacuum envelope of the gun and tube.

Grid support and retaining subassembly 25 associated with leading end 52 includes a base annular support 75 having an inner hollow diameter and which radially inwardly extends close to, but is radially spaced from, cathode cylinder portion 68, to preserve isolation between the RF signal and DC beam potential. Base support 75 defines an annular flat face 76 transverse to the tube axis, and facing anode 15, and which matches a peripheral region 78 grid 24. The grid support assembly also includes annular end member or flange 60 positioned axially between base support 75 and anode 15, and of an axial depth much smaller than its radius. Flange 60 includes annular groove 59, defined on the flange within a second flat annular face 78 fronting on base support 75 away from anode 15 and complementing face 76. Within groove 59, the annular deformable contact element 58, preferably a metallic braid of Monel alloy, has a thickness which is greater than the depth of the groove, so that the braid protrudes, but which also is substantially smaller than the grid diameter. Other materials could also be used to constitute contact element 58; for example, stock comprising multiple spring fingers. Grid 24 is captured between end flange 60 and base 75, upon the flange being secured to the base by screws. However, flange 60 is secured so that the solid metal of the flange does not contact or compress the grid directly, but rather only by means of braid 58. In this manner, a very adequate but resilient clamping force which does not distort the delicate grid is provided.

It will be appreciated that the expansion coefficients of the grid support assembly metal are substantially greater than that of the graphite material of the grid. The combination of the braid with the groove also accurately maintains the lateral or radial position of the grid with respect to the axis, yet shearing action is also permitted, to relieve the stress of the differential expansion of the several materials upon heating during processing and operation. Along with the accommodation of relative expansion, grid support assembly 25 also insures a superior level of thermal and electrical conductivity, since full wiping contact between annular face 76 and the corresponding facing peripheral region 77 of grid 24 is positively assured by the resilient clamping action of assembly 25. Similarly, with the aid of deformable contact 58, positive electrical and thermal continuity is also maintained between grid region 77 and annular face 78 despite expansion, with the braid deforming to insure a large contact area. Moreover, the design of the grid itself is such as to minimize grid expansion except in the plane of the grid as will be seen below. Yet this arrangement closely maintains the original dimensional relationships quite precisely. Since the grid-to-cathode spacing is typically 5 to 50 mils, while the thickness of the grid itself is typically of the order of 20 mils or less, it is critical to the functioning of the tube to achieve proper support for the grid under all operating conditions.

Figure 3:
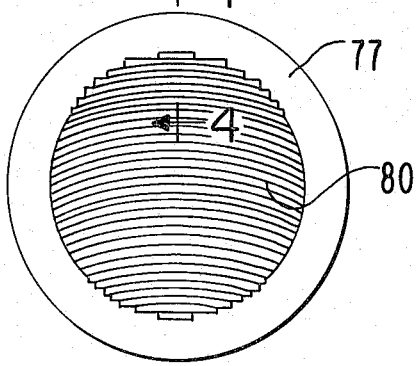
FIG. 3 is an enlarged detailed plan view of the grid employed in the gun assembly of FIG. 2.
Figure 4:
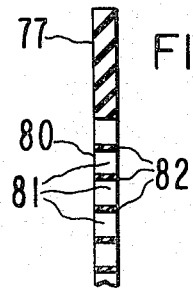
FIG. 4 is an enlarged detail cross-sectional view of the grid of FIG. 3, taken along line 4—4.

FIGS. 3 and 4 show details of the grid design. The thin flat disc 24 is of a highly dimensionally-stable and heat-resistant form of carbon, preferably pyrolytic graphite. Such a grid material also has the advantage of being intrinsically black and thus an inherently good heat radiator. Disc 24 is provided with a central active area 80 approximating the diameter of the cathode, and within which are formed, preferably by laser machining, apertures 81 to permit the electrons to move through the grid from the cathode into the anode region. The result is that active area 80 comprises an array of parallel uniform grid bars 82, uniformly spaced. The grid disc also is left with solid narrow peripheral annular region or band 77 at the outermost edge, comparable in diameter to that of the groove 59 or braid 58, upon which the braid 58 bears when the grid is positioned in working engagement with grid support assembly. This band helps insure a superior thermal and electrical pathway between the grid and grid support assembly. In one of the typical smaller embodiments the overall diameter is 1.5 in., and that of the working area is 1.0 in., for an active area of approximately 0.8 sq. in. However, active areas between approximately 0.6 to at least 16 sq. in. are now also feasible.

As further illustrated in FIG. 4, the elongated evenly-spaced grid bars 82, preferably of rectangular cross-section, are quite narrow in the plane of the grid compared to their axial thickness and the apertures 81 therebetween. Their pitch is typically $1\frac{1}{2}$ times the grid-to-cathode distance, while their width is preferably $\frac{1}{4}$ the pitch, or $\frac{1}{2}$ the grid-to-cathode distance. It has been found that forming grid bars 82 with some form of slight curvature within the plane of the grid, as shown in FIG. 3, encourages any expansion due to heating during operation to occur also in the same sense, and thus to insure that the elements stay in the plane of the grid. Otherwise, any buckling inwardly would, considering the close spacings involved, cause grid-to-cathode shorting, or if outward, degrade the operating characteristics of the tube. Of course, as described above, a primary purpose of the grid support means design is also to help alleviate the problem of differential expansion during operation, which would otherwise contribute to such buckling.

Very close spatial tolerances thereby are maintained even under extreme temperature conditions of high power operation, and high beam acceleration voltages. Further, differential expansion of the various elements is accommodated while avoiding mechanical stress and providing good mechanical support, as well as providing a path of high electrical integrity, reliability, and low impedance for the RF signal. At the same time, the construction of the input signal means 47 keeps to a minimum the axial length of any coaxial current paths, as well as maximizing the spacing and insulating qualities between conductors. For example, cathode lead-in member 55 is substantially axially spaced and insulated from grid support assembly 25. Also, it is quite shallow axially, is recessed, and thus is coaxial with only a short axial portion of RF lead-in sleeve 50, while moreover, its shortest radial spacing therefrom is still considerable. Both cathode lead-in 55 and RF lead-in sleeve 50, in turn, are both insulated and substantially axially spaced from anode 15.

In this manner, those current paths of the respective leads which are axially coextensive and adjacent are reduced to a minimum. Also, the physical separation between respective cathode and grid lead-ins is maximized, and the relative smallness of the inner cathode lead-in 55 relative to the outer surrounding lead 50, both in diameter and axial extension, aids in establishing such separation. The intervening ceramic supports 48 and 54 further enhance the electrical isolation between respective circuits, and with respect to the anode or ground. The result is a gun assembly which exhibits minimal shunt capacitance and series inductance. Besides providing a very efficient and very low reactance paths for the incoming modulating signal, the assembly has excellent wide bandwidth characteristics.

The design of signal lead-in and grid support assemblies 47 and 25, together with that of grid 24, contribute to the high power and efficiency capabilities of the tube, at levels much better than would have heretofore been expected from a tube of this type. These designs enable a large beam current and large beam cross-section necessary to the high power levels to be supported. The grid assembly design is for a comparatively wide grid area, so that beam current densities are moderate, despite high beam current and voltage. Even with the large grid area, the grid design and mounting preserves positional accuracy while allowing expansion without deformation. The very close grid-to-cathode spacings mentioned above thereby are made feasible, minimizing transit time losses and the risks of shorts and variations in characteristics with temperature, while enhancing beam modulation, high frequency capabilities, and efficiency. The useful frequency range of the tube extends not only through the VHF and UHF bands, but into the microwave region as well. The useful lifetime of the tube is also enhanced beyond what would be expected under these relatively high output conditions, thanks to the provisions for accommodating expansion and grid size. Cathode life expectancy is also enhanced, since emission density requirements are correspondingly lower than otherwise necessary for a given power level; also, dissipation of energy due to current interception by the grid and anode is relatively lower. These features, along with the low impedance RF signal path to the grid, also contribute to enabling efficient application of heavy RF control current to the grid and ultimately the beam while minimizing thermal loads due to current losses. The tube is capable of at least 20 kilowatt CW power output levels; and much higher outputs should be achieved, levels which heretofore have been totally unexpected for this type of tube and with a good adaptability to use over a wide bandwidth as well. One or more additional grids as in certain tetrodes or pentodes, and additional accelerating apertures could also be provided.

Still other desirable features of the tube are related to the high average electron velocities and cross-sections of the electron beam, and also contribute to the enhanced power output, efficiency and other desirable operating characteristics. As FIG. 2 shows, the electron beam is a relatively long one, as are the field-free drift regions, and the output gap. The output interaction gap 35 extends axially typically twice the radius of the anode drift tube 17, for enhanced beam-wave interaction and efficiency. The overall drift tube means extend axially a distance at least of the order of five times its largest diameter, providing long field-free drift regions on either side of the gap of relatively long length. The relatively long field-free drift regions give rise to enhanced isolation of the output interaction space of the output cavity from the input space and the collector. This isolation effect, employing the properties of a waveguide beyond cutoff, prevents variations in tuning or loading of the output, undesirably influencing the modulating or input circuits. Despite the length of the field-free drift regions, the beam does not change appreciably in diameter. The beam diameter and tube diameter remain comparable, the beam is essentially non-intercepting, and the diameter of the tail pipe part gap 35 is only fractionally larger than that of the anode drift tube, due to the large average electron velocities and the focusing imposed by the magnetic field.

What is claimed is:

1. A linear-beam vacuum tube having a longitudinal axis for use with inductive-circuit output means, and means providing an axial magnetic field, said tube comprising:

an axially centered electron gun assembly at one end of said tube having a thermionic cathode and an anode spaced therefrom, said anode and cathode operable at a minimum several kilovolts DC electrical potential therebetween to form and accelerate along said axis an electron beam;

an axially centered grid comprising a temperature-resistant form of carbon between said cathode and anode, closely spaced a predetermined distance from said cathode, and accepting a high frequency control signal to density modulate said beam;

low impedance signal input means for supplying both said high frequency control signal to said grid, and said DC electrical potential to said cathode;

means associated with said signal input means for supporting said grid to accommodate relative expansion while accurately maintaining said predetermined grid-cathode distance;

axial collector means at the other end of said tube for accepting and dissipating therein the electrons of said beam remaining after transit across said tube; and axial drift tube means enclosing said beam and extending between said gun assembly and collector, said tube means including a first portion and a second portion, both said tube portions being elongated relative to their diameters, the internal diameter of at least said first portion being substantially uniform, a gap being defined between said first and second portions, said gap communicating with said inductive-circuit output means, said magnetic field focusing and confining said beam from said cathode through said drift tube means at least to said gap.

2. A tube as in claim 1 in which the length of said drift tube means is of the order of five or more times the maximum diameter of said tube.

3. A tube as in claim 1 which further includes a hollow ceramic envelope of diameter greater than the maximum diameter of said drift tube outside and about said drift tube, said envelope being adaptable to establishment of a sub-atmospheric environment therein, and in which said inductive circuit output means is at least partially within said envelope.

4. A tube as in claim 1 in which both said cathode and grid are configured as flat discs, said initial diameter of said beam is of the order of 1 inch or more, and the diameter of said grid is at least said initial diameter.

5. A tube as in claim 1 in which said distance of said grid from said cathode is 1/20th the diameter of said grid or less, and in which said grid has a thickness half said grid cathode distance or less.

6. A tube as in claim 1 in which said grid defines an active area through which said beam passes comprised of a plurality of elongated parallel bars, said bars being at least somewhat curved in the plane of said grid, said bars being narrow in the plane of the grid as compared to their axial thickness.

7. A tube as in claim 1 in which said first drift tube portion is shorter in length than said second drift tube portion.

8. A tube as in claim 1 in which said magnetic field focuses said beam to a first diameter, said internal diameter of said first drift tube portion being somewhat greater than said first diameter for minimal interception of said beam.

9. A tube as in claim 1 in which the maximum internal diameter of said second drift tube downstream of said gap is somewhat larger than the internal diameter of said first tube portion.

10. A tube as in claim 1 in which said means for supporting said grid includes defining a first flat annular surface transverse to said axis and facing said anode, and a matching second flat annular surface oriented away from said anode, said means for supporting further including an annular deformable conductor, said deformable conductor being of a diameter less than said grid, said conductor being compressed between one of said surfaces and one side of a peripheral region of said grid whereby said grid is evenly supported while differential expansion is permitted.

11. A tube as in claim 1 in which said kilovolt DC potential range upwardly to the order of 30 kilovolts.

12. A tube as in claim 1 in which said temperature-resistant form of carbon is pyrolytic graphite.

13. A tube as in claim 1 in which said cathode defines a concave emitting surface, and said grid is of a complementary concave shape.

14. A tube as in claim 10 in which an annular groove is defined in one of said annular surfaces, said annular deformable conductors being positioned within said groove so as to protrude from said one annular surface.

15. A tube as in claim 10 in which said annular deformable conductor is a metallic braid.

16. A linear beam electron tube having a longitudinal axis for use with an inductive-circuit output means, including a resonant cavity, and means providing a magnetic electron-beam focusing field, said tube comprising;

an axially centered electron gun assembly at one end of said tube having a thermionic cathode and an anode spaced therefrom, said anode and cathod operable at a minimum several kilovolts DC electrical potential therebetween to form and accelerate along said axis an electron beam;

axial collector means at the other end of said tube for accepting and dissipating therein the electron of said beam remaining after transit across said tube;

axial drift tube means enclosing said beam and extending between said gun assembly and collector, said drift tube means interrupted by a gap generally intermediate said gun and collector, said gap opening into said cavity;

an axially centered grid between said cathode and anode, closely spaced a predetermined distance from said cathode, and accepting a high-frequency control signal to density-modulate said beam, said distance being one-twentieth the diameter of said grid or less, said grid having a thickness half said distance or less, said grid defining a central active area and a peripheral support region;

an inner grid support member apertured for passage of said beam, positioned adjacent and outwardly of said cathode, and transmitting said control signal;

an outer grid support member positioned axially between said inner grid support member and said anode, said grid being held peripherally between said members; and a thin annular resilient conductive contact means of diameter similar to said grid peripheral support region, captured between said grid and at least one of said members, said means permitting differential expansion under heat of said members and grid without distortion of said grid while maintaining said grid accurately in said position.

17. A tube as in claim 16 in which said grid is flat and is comprised of a plurality of narrow elongated evenly spaced bars.

18. A tube as in claim 17 in which said bars are curved within the plane of said grid.

19. A tube as in claim 18 in which said bars are thicker in the axial direction than their width in the plane of the grid.

20. A tube as in claim 17 in which said bars are spaced to exhibit a pitch of approximately one and one-half said cathode-grid distance or less.

21. A tube as in claim 17 in which said bars have a width in the plane of the grid of approximately half said cathode-grid distance or less.

22. A tube as in claim 16 in which said annular contact means has a width substantially smaller than that of said grid perhipheral region.

23. A tube as in claim 16 in which said contact means in which said contact means contacts said grid only over said grid peripheral region.

24. A tube as in claim 16 in which said inner and outer support members define respective first and second flat annular surfaces transverse to said axis and within which said grid is enclosed.

25. A tube as in claim 16 in which said contact means comprises at least one deformable thin elongated bent conductor arranged in an annular pattern over said peripheral support region of said grid.

26. A tube as in claim 16 in which said contact means comprises a thin elongated conductor forming an annulus and having multiple spring fingers extending therefrom.

27. A tube as in claim 16 in which said grid is of the order of 20 mils or less in thickness.

28. A tube as in claim 16 in which said cathode includes a planar surface facing said grid, and in which said grid is planar and spaced between approximately 5 and 50 mils from said planar surface of said cathode.

29. A tube as in claim 16 in which said grid is between approximately 0.6 and 16 square inches in active area.

30. A tube as in claim 16 in which said grid is of a heat resistant carbon material.

31. A linear beam electron tube having a longitudinal axis for use with an inductive-circuit output means including a resonant cavity, and means providing an electron-beam focusing field, said tube comprising:

an axially centered electron gun assembly at one end of said tube having a thermionic cathode and an anode spaced therefrom, said anode and cathode operable at a minimum several kilovolts DC electrical potential therebetween to form and accelerate along said axis an electron beam;

axial collector means at the other end of said tube for accepting and dissipating therein the electrons of said beam remaining after transit across said tube;

axial drift tube means enclosing said beam and extending between said gun assembly and collector, said drift tube means interrupted by a gap generally intermediate said gun and collector, said gap opening into said cavity;

an axially centered grid between said cathode and anode, closely spaced a predetermined distance from said cathode, and accepting a high-frequency control signal to density-modulate said beam, said distance being one-twentieth the diameter of said grid or less, said grid having a thickness half said distance or less, said grid defining a central active area and a peripheral support region;

an inner grid support member apertured for passage of said beam, positioned adjacent and outwardly of said cathode, and transmitting said control signal;

an outer grid support member positioned axially between said inner grid support member and said anode, said grid being held peripherally between said members;

said inner and outer support members defining respective first and second flat annular surfaces transverse to said axis and within which said grid is enclosed, an annular groove being defined on the of said annular surfaces;

a thin annular conductive contact means for insertion between said grid and at least one of said members, said annular contact means being positioned within said groove so as to protrude from said one annular surface, said means permitting differential expansion under heat of said members and grid without distortion of said grid while maintaining said grid accurately in said position.

32. A linear beam electron tube having a longitudinal axis for use with an inductive-circuit output means including a resonant cavity, and means providing an electron-beam focusing field, said tube comprising:

an axially centered electron gun assembly at one end of said tube having a thermionic cathode and an anode spaced therefrom, said anode and cathode operable at a minimum several kilovolts DC electrical potential therebetween to form and accelerate along said axis an electron beam;

axial collector means at the other end of said tube for accepting and dissipating therein the electrons of said beam remaining after transit across said tube;

axial drift tube means enclosing said beam and extending between said gun assembly and collector, said drift tube means interrupted by a gap generally intermediate said gun and collector, said gap opening into said cavity;

an axially centered grid between said cathode and anode, closely spaced a predetermined distance from said cathode, and accepting a high-frequency control signal to density-modulate said beam, said distance being one-twentieth the diameter of said grid or less, said grid defining a central active area and a peripheral support region;

an inner grid support member apertured for passage of said beam, positioned adjacent and outwardly of said cathode, and transmitting said control signal;

an outer grid support member positioned axially between said inner grid support member and said anode, said grid being held peripherally between said members; and a thin annular conductive contact means comprising a metallic braid for insertion between said grid and at least one of said members, said means permitting differential expansion under heat of said members and grid without distortion of said grid while maintaining said grid accurately in said position.

33. A linear beam electron tube having a longitudinal axis for use with an inductive-circuit output means including a resonant cavity, and means providing an electron-beam focusing field, said tube comprising;

an axially centered electron gun assembly at one end of said tube having a thermionic cathode and an anode spaced therefrom, said cathode defines a concave emitting surface, said anode and cathode operable at a minimum several kilovolts DC electrical potential therebetween to form and accelerate along said axis an electorn beam;

axial drift tube means enclosing said beam and extending between said gun assembly and collector, said drift tube means interrupted by a gap generally intermediate said gun and collector, said gap opening into said cavity;

an axially centered grid between said cathode and anode, closely spaced a predetermined distance form said cathode, and accepting a high-frequency control signal to density-modulate said beam, said grid being of a concave shape complementing said concave emitting surface, said distance being one-twentieth the diameter of said grid or less, said grid having a thickness half said distance or less, said grid defining a central active area and a peripheral support region;

an inner grid support member apertured for passage of said beam, positioned adjacent and outwardly of said cathode, and transmitting said control signal;

an outer grid support member positioned axially between said inner grid support member and said anode, said grid being held peripherally between said members; and a thin annular conductive contact means for insertion between said grid and at least one of said members, said means permitting differential expansion under heat of said members and grid without distortion of said grid while maintaining said grid accurately in said positon.

34. A grid and signal assembly for electron gun for an electron tube having a cathode and an anode, said assembly comprising:

a control grid between said cathode and anode;

an outer annular insulator extending at one end to said anode and having a first diameter larger than said cathode and grid;

a generally annular grid lead having a leading end of a second diameter less than said first diameter, said grid lead being mounted at its trailing end to the other end of said insulator so as to position said leading end toward said anode, said leading end defining a first annular surface facing said anode;

a cathode lead within and spaced from said grid lead;

an inner annular insulator within and in spaced relationship to said grid lead intermediate said cathode lead and leading end of said grid lead; and mounting said cathode lead to said leading end;

a cathode lead extension projecting axially through said inner insulator to a position adjacent said leading end, and mounting said cathode at said position;

an annular metallic flange defining a second annular surface generally matching said first annular surface; and an annular deformable contact element of diameter less than the largest diameter of said annular surfaces, for insertion between said grid and one of said annular surfaces, and capturing said grid over its periphery between said element and the other of said annular surfaces upon said flange being mounted to said leading end of said grid lead.

35. The assembly of claim 34 in which said deformable element comprises a resilient metallic conductor of width less than that of said annualr surfaces.

36. The assembly of claim 34 in which said deformable element comprises a metallic braid.

37. The assembly of claim 36 in which said metallic braid is of a Monel alloy.

38. An assembly as in claim 34 in which said grid is of graphite, is planar, in which the cathode portion adjacent said grid is planar, and in which said annular surfaces are flat.

39. An assembly as in claim 34 in which an annular groove is defined in one of said annular surfaces, said deformable element being positioned within and protruding from said groove.

40. An assembly as in claim 39 in which said element has a transverse thickness larger than the depth of said groove, whereby the element protrudes from said groove.

41. An assembly as in claim 34 which further includes fastening means for fastening said flange to said leading end of said grid lead.

42. An assembly as in claim 41 in which said fastening means compresses said flange toward said leading edge to the extent of permitting only said deformable element to contact the grid.

43. An assembly as in claim 34 in which the depth of said annular flange is substantially smaller than its radius.

44. An assembly as in claim 43 in which said leading end of said grid lead defines an annular plate portion generally complementary to said annular flange.

45. An assembly as in claim 34 in which said insulators, lead, flange and anode define a common central longitudinal axis, and in which said anode and said annular surfaces are perpendicular to said axis.

46. An assembly as in claim 34 in which said cathode and grid are spaced from each other a distance of from approximately 5 to 50 mils.

47. An assembly as in claim 34 in which said grid is of a thickness up to the order of 20 mils.

48. An assembly as in claim 34 in which said grid includes an active area of between approximately 0.6 to 16 square inches.

49. An assembly as in claim 34 in which said grid is flat, and the active area of said grid is comprised of a purality of regularly spaced narrow elongated members, said members being narrow in comparison to their axial thickness, said elongated members being curved in the plane of said grid.

50. An assembly as in claim 34 in which said anode is annular.

51. In a vacuum tube modulated by a high-frequency control signal in which said tube includes an electron beam source with an accelerating electrode associated with said tube, an electron emitting cathode spaced from said accelerating electrode, and adaptable to establishment of a high DC potential therebetween in operation, and a grid between and spaced from said electrode and cathode for modulating said beam in accordance with said control signal, a wide-band signal input assembly comprising:

annular outer insulator means having leading and trailing end portions, said leading end portion being sealed to said electrode;

annular electrically conductive grid lead means having a trailing end portion sealingly mounted to said insulator means trailing end portion, and a leading end portion extending toward said electrode within and spaced from said annular insulator means, and spaced from said electrode, said grid being mounted to said leading end portion of said grid lead means;

electrically conductive cathode lead means positioned within and in spaced relationship to said grid lead means;

inner insulator means mounting said cathode lead means to said grid lead means, and said cathode lead means mounting said cathode adjacent said grid;

said cathode lead means having a trailing end recessed substantially closer to said electrode than is said trailing end of said grid lead means;

and grid support means associated with the leading end of said grid lead means for resiliently and accurately holding said grid in close predetermined spacing to said cathode, said grid being mounted to said leading end of said grid lead means in good electrical contact thereto between said end and said electrode;

said grid support means including an annular metallic member of substantially smaller axial depth than said grid lead means, said member and the leading end of said grid lead means defining opposable annular surfaces, said support means further including an annular resilient member, said resilient member being of a diameter less than the largest diameter of said opposable annular surface, said grid being captured adjacent the periphery thereof between one of said annular surfaces and said resilient member, said resilient member further bearing on the other of said annular surfaces.

52. In a vacuum tube modulated by a high-frequency control signal in which said tube includes an electron beam source with an accelerating electrode associated with said tube, an electron emitting cathode spaced form said accelerating electrode, and adaptable to establishment of a high DC potential therebetween in operation, and a grid between and spaced form said electrode and cathode for modulating said beam in accordance with said control signal, a wide-band signal input assembly comprising:

annular outer insulator means having leading and trailing end portions, said leading end portion being sealed to said electrode;

annular electrically conductive grid lead means having a trailing end portion sealingly mounted to said insulator means trailing end portion, and a leading end portion extending toward said electrode within and spaced from said annular insulator means, and spaced from said electrode, said grid being mounted to said leading end portion of said grid lead means;

electrically conductive cathode lead means positioned within and in spaced relationship to said grid lead means;

inner insulator means mounting said cathode lead means to said grid lead means, and said cathode lead means mounting said cathode adjacent said grid;

said cathode lead means having a trailing end recessed substantially closer to said electrode than is said trailing end of said grid lead means;

and grid support means associated with the leading end of said grid lead means for resiliently and accurately holding said grid in close predetermined spacing to said cathode, said grid being mounted to said leading end of said grid lead means in good electrical contact thereto between said end and said electrode;

said grid support mean including an annular metallic member of substantially smaller axial depth than said grid lead means, said member and the leading end of said grid lead means defining opposable annular surfaces, said support means further including an annular resilient member, said grid being captured adjacent the periphery thereof between one of said annular surfaces and said resilient member, said resilient member further bearing on the other of said annular surfaces;

said one of said annular surfaces having defined therein a groove, said groove receiving said resilient member.

53. An assembly as in claim 52 in which the depth of said groove is less than that of said resilient member.

54. An assembly as in claim 53 in which said resilient member comprises a metallic braid.

55. A tube as in claim 16 in which said distance is of the order of 1/100th the diameter of said grid.

56. A linear-beam electron tube for use with a resonant cavity means for extracting output power, said tube comprising:

a relatively flat cathode;

a grid to enable density-modulation of said beam by a control signal, said grid being of a heat resistant carbon material closely spaced a predetermined distance form said cathode;

a hollow anode;

a drift tube for containing said linear beam of electrons, said tube having defined therein a gap;

said resonant cavity being positioned about said drift tube and being connected tosaid tube on both sides of said gap;

said drift tube being of relatively uniform internal diameter from said anode at least past said gap, and being elongated relative to said internal diameter;

means for sustaining an axial magnetic field for focusing a uniform beam of electrons from said cathode at least through said gap; and a collector downstream of said cavity, and enlarged in diameter relative to said drift tube.

57. A tube as in claim 56 in which said grid is spaced from said cathode a distance one-twentieth the diameter of said grid or less, and in which said grid has a thickness half said distance or less.

58. A tube as in claim 56 in which said heat-resistant carbon material is pyrolytic graphite.

59. A tube as in claim 56 in which further includes means for maintaining said first predetermined distance between said grid and said cathode, said means defining a first flat annular surface facing said anode, a matching second flat annular surface oriented away from said anode, and an annular resilient conductive contact means, said grid being peripherally captured between one of said surfaces and one side of said annular contact means, the other side thereof bearing on the other of said surfaces.

60. A tube as in claim 59 in which said contact means comprises a metallic braid.

61. A tube as in claim 56 in which said magnetic field focuses said beam to a diameter less than said internal diameter of said drift tube.

62. A tube as in claim 61 in which said magnetic field confines said beam as it travels within said drift tube, said beam thereafter expanding and dissipating into the collector.

63. A tube as in claim 56 in which said beam is of a diameter somewhat less than said internal tube diameter.

64. A tube as in claim 56 in which the tube portion upstream of said gap is shorter in length than that downstream of said gap.

65. A tube as in claim 56 in which tube further includes a vacuum envelope, and said resonant cavity is included within said envelope.

66. A gun for generating a density-modulated linear beam of electrons comprising:

a thermionic cathode with a flat emissive surface;

a radiant heater facing said cathode on the side opposite said emissive surface;

a flat grid of heat-resistant carbon material; and means for maintaining said grid parallel to and at a closely spaced predetermined distance from said emissive surface, including a pair of annular grid supports, each with an aperture at least as large as said emissive surface, a first of said supports having a flat face in contact with a first side of the peripheral region of said grid;

a second, conductive support having a side facing the second side of said peripheral region and spaced therefrom;

a deformable conductive means compressed between said second, conductive, annular support and said peripheral region of said grid whereby said peripheral region can slide over said first support; and means for mounting said cathode and said grid supports in fixed insulated relation.

67. A gun as in claim 66 in which said second conductive annular support is provided with a peripheral groove, said deformable conductive means being positioned within said groove so as to protrude form the surface of said second support to contact said peripheral region of said grid.

68. A gun as in claim 66 in which said deformable conductive means comprises at least one deformable thin elongated bent conductor member arranged in an annular pattern.

69. A gun as in claim 68 in which said conductor means includes a plurality of said conductor members defining a braid.

70. A gun as in claim 66 in which said deformable conductive means comprises thin annular member having multiple conductive spring fingers extending therefrom.

71. A gun as in claim 66 in which said grid material is pyrolytic graphite.

72. A gun as in claim 66 in which said grid is comprised of a plurality of elongated parallel bars having a curvature in the plane of said grid, said bars being at least slightly spaced from each other.

73. A gun as in claim 72 in which said peripheral region of said grid is a continuous solid.

74. A gun as in claim 72 in which said deformable conductive means had a width less than that of said peripheral region of said grid.

75. A gun as in claim 66 in which said deformable conductive means is of an annular form of diameter similar to or less than said peripheral region of said grid.

* * * * *